US005393566A

United States Patent [19]

Propst

[11] Patent Number: 5,393,566

[45] Date of Patent: Feb. 28, 1995

[54] RECYCLABLE PLASTIC COATED CONTAINERS

[75] Inventor: Charles Propst, Gettysburg, Pa.

[73] Assignee: Tim-Bar Coproration, Hanover, Pa.

[21] Appl. No.: 966,835

[22] Filed: Oct. 27, 1992

[51] Int. Cl.[6] ..... B05D 3/04; B05D 3/12

[52] U.S. Cl. ..... 427/348; 427/358; 427/361; 427/366; 427/391; 427/428; 118/62; 118/63; 118/248

[58] Field of Search ..... 427/348, 358, 361, 365, 427/366, 391, 428, 442; 118/62, 63, 248

[56] References Cited

U.S. PATENT DOCUMENTS

| | | | |
|---|---|---|---|
| 2,554,662 | 5/1951 | Cowgill | 427/361 |
| 3,235,401 | 2/1966 | Fowells et al. | 427/348 |
| 3,320,086 | 5/1967 | Rose et al. | 427/348 |
| 3,329,523 | 7/1967 | Best et al. | 427/348 |
| 3,356,517 | 12/1967 | Nakajima et al. | 427/366 |
| 3,574,668 | 4/1971 | Cherney | 427/361 |
| 3,963,820 | 6/1976 | Blakey | 427/365 |
| 4,242,380 | 12/1980 | Courtoy | 427/366 |
| 4,520,048 | 5/1985 | Ranger | 427/428 |
| 4,749,432 | 6/1988 | Ando et al. | 427/358 |
| 4,929,470 | 5/1990 | Rittenhouse et al. | 427/366 |
| 5,252,640 | 10/1993 | Cope | 427/262 |

*Primary Examiner*—Shrive Beck
*Assistant Examiner*—Brian K. Talbot
*Attorney, Agent, or Firm*—Stevens, Davis, Miller & Mosher

[57] ABSTRACT

Recyclable containers such as corrugated or folding boxes are made from a coated paper or kraft grade sheet including a plastic coating thereon. Aqueous acrylic resin containing compositions can be applied in excess on the paper or kraft grade sheet and the unwanted coating metered and removed by directing a jet of air at the coating. After solidification of the coating, the coated paper or kraft sheets can be incorporated as components of corrugated or folding boxes. Recovery of the unwanted coating permits recycling of the coating component. Corrugated and folding boxes including the components can be recycled by conventional repulping processes. A process of manufacture of the coated sheets is also disclosed.

5 Claims, 1 Drawing Sheet

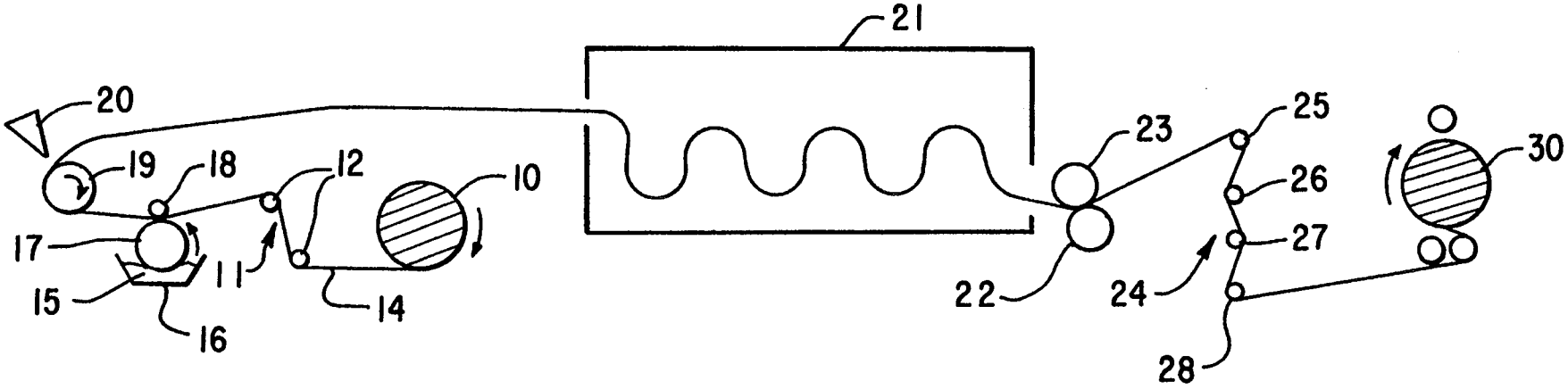
30
25
26
27
28
24
23
22
21
10
14
12
11
18
16
19
20
17
15

RECYCLABLE PLASTIC COATED CONTAINERS

BACKGROUND OF THE INVENTION

1. Field of the Invention

The invention relates to coated paper and kraft grades suitable for use as liners for containers, such as containers known as a corrugated box or folding box (the latter which does not require a corrugation process to be formed). More specifically, the invention employs the use of plastic materials as the coating substance which is applied to the paper or kraft grade materials by contact with a roller coated with the plastic material in a fluid state but in an excessive amount. An airflow is directed towards the plastic coated surface of the paper or kraft to meter or remove unwanted amounts of coating. The coated paper or kraft, after solidification of the coating, is rewound into roll form for subsequent use in forming containers.

2. Background of the Invention

Formation of wax coated containers, using paper grades and kraft grades of liner, is known in the art. A major problem associated with such prior art containers, in which the component parts are coated with wax, is that the containers are not readily recyclable and cannot be pulped by conventional repulping processes.

Additionally, it is necessary to adhere the prior art coated liners to the other components of the container with hot melt adhesives, thereby requiring additional energy and resources of the container forming industry in utilizing wax coated components of the prior art.

Thus, a need exists for coated papers or krafts which avoids these and other deficiencies of the prior art.

SUMMARY OF THE INVENTION

The present invention provides novel coated paper and kraft grade materials having particular utility as components for containers of the corrugated box or folding box types.

It is therefore an object of the present invention to provide novel coated paper and kraft grade materials.

It is an additional object of the invention to provide a process for forming such novel coated paper and kraft grade materials.

It is a further object of the invention to provide novel materials as components of corrugated and folding boxes facilitating the recycling thereof by conventional repulping processes.

These and other objects of the invention will be apparent from the following description of the invention and by reference to the accompanying drawing.

BRIEF DESCRIPTION OF THE DRAWING

The sole figure is a schematic representation of a process and apparatus for forming coated paper and kraft materials according to the present invention.

DETAILED DESCRIPTION OF THE INVENTION

As illustrated in the sole figure of the drawings, 10 represents roll stock, which may be either paper or kraft grade materials. Roll stock 10 is mounted on an unwinding stand (not shown) and allowed to turn freely to feed the paper or kraft grade material (hereinafter referred to as "sheet 14") from roll stock 10 through a section 11 of free turning and power assisted rolls, only two of which are generally illustrated by reference numeral 12. It is understood that other numbers of and arrangement of rolls 12 in section 11 may be utilized, as the section 11 does not constitute an inventive feature, per se.

A source of coating material 15 is maintained within pan 16. The level of coating material 15 is controlled within pan 16 so as to apply a predetermined amount of coating (not shown) to roller 17. Roller 17 rotates in the direction of the arrow to transfer a predetermined amount of coating thereon (not shown) to the finished or good side of sheet 14. The nip between roller 18 and roller 17 causes the predetermined amount of coating to be transferred to sheet 14 in an amount in excess of that desired in the finished coated paper or kraft material.

Sheet 14, bearing a coating (not shown) on its good or finished side is transferred about roll 19 so as to bring the coating (not shown) into proximity to a directed jet of fluid, preferably a gas, most preferably air, so as to meter and remove the unwanted amounts of coating from sheet 14. The directed jet of fluid may emanate from a device such as an Airknife TM (John Waldron Corporation, New Brunswick, N.J.) or any similar device 20 capable of directing a high speed flow of fluid over the surface of sheet 14, carrying excess coating thereon, in order to meter or remove unwanted coating therefrom.

The metered and coated sheet 14 is then fed to any suitable device for effecting solidification of the coating, such as drying unit 21. Drying unit 21 can be provided with continuous conveying means, such as suitable tracks and bars, well known, per se, to handle the metered and coated sheet 14 until the coating has solidified. Drying unit 21 can be augmented with associated apparatus comprising cooled or heated air flows, radiant or microwave heaters, suction or similar devices to facilitate the at least the partial solidification of the coating on sheet 21 within drying unit 21. Preferably, the coating is completely solidified upon exit from drying unit 21.

Guide rolls 22, 23 remove the now solidified coated sheet 14 from drying unit 21.

Tension unit 24 comprising a series of rollers 25, 26, 27, 28 maintain tension on the solidified coated sheet 14 in preparation for rewinding the now coated sheet 14 into roll form 30.

Roll form 30 may be further processed on site or shipped to manufacturers of corrugated and folding boxes.

The disclosed process is designed to produce coated paper or kraft grade materials having uniform coatings thereon in an efficient and environmentally friendly manner.

The present inventor has found that the use of plastic coating materials, especially aqueous acrylic resin based compositions, produces coated paper and krafts with high uniformity of coating. Such coated papers and krafts can be utilized as components in the corrugated and folding box industries and, unlike the prior art wax coated components, can be adhered to itself and other components by the use of cold set adhesives. The resulting corrugated and folding boxes can be recycled after use by conventional repulping processes, unlike boxes formed of wax-coated components.

The invention will be further illustrated by reference to the following Example.

EXAMPLE

A sheet of paper stock is coated utilizing the apparatus illustrated in the accompanying figure with an aqueous acrylic resin composition formed from Components A, B and C having the following typical properties:

| TYPICAL CHARACTERISTICS | |
|---|---|
| COMPONENT A | |
| Appearance | Amber clear solution |
| Non-volatile | 34.0 ± 0.5% resins solids |
| pH | 8.3–8.6 |
| Viscosity | 2500 ± 500 cps (Brookfield) |
| Lbs./gal. | 8.7 ± 0.1 |
| Density | 1.07 |
| Acid Number | 70 |
| Tg. | 95° C. |
| Flash point | 115° C. |
| Freeze/Thaw Stability | Yes |
| COMPONENT B | |
| Appearance | Translucent Emulsion |
| Non-volatiles | 40% |
| pH | 2.5–3.5 |
| Viscosity | 25–35 cps |
| Weight per gallon | 8.7 lbs. |
| M.F.T. | 8° C. |
| Tg | 0° C. |
| Acid number | 58 (@ 100% NV) |
| COMPONENT C | |
| A 35% solids polyethylene wax emulsion having the following typical properties: | |
| Non-volatiles | 34.7–35.3% |
| pH | 9.0–9.5 |
| Weight per gallon | 8.27 lbs. |

Components A, B and C are mixed in approximate parts (by weight) of 15:65:6 in admixture with 5.5 HOH, 0.5 $NH_4OH$, 3 zinc oxide solution, under strong agitation.

All of the foregoing proportions can be varied plus or minus 10% and still display the performance of the finished coating.

The Components A, B and C, to be used in formulating the composition of the invention, are commercially available from S.C. Johnson & Sons, Inc., U.S. Specialty Chemicals, 1525 Howe Street, Racine, Wisconsin under the trademarks JONCRYL 61LV, JONCRYL 82 and JONCRYL 28, respectively. These products are described in Technical Service Information bulletins of Johnson Wax Specialty Chemicals, the substance of which are incorporated herein by reference.

JONCRYL 82 is an acrylate acrylic polymeric composition containing styrene units compatible with various solvents including methanol, 3A ethanol, isopropanol, n-propanol, ethylene glycol monobutyl ether, diethylene glycol monoethyl ether, acetone, methylene ketone and methyl isobutyl ketone. Heat resistance of JONCRYL 82 can be further increased by crosslinking the polymer with a zinc oxide solution which produces stable viscosities at higher pH. The maximum workable pH of JONCRYL 82 can be increased from 7 to 9 by incorporating a zinc oxide solution.

JONCRYL 61LV is a high molecular weight acrylic resin. JONCRYL 61LV can be formulated as a solution in a ball-mill or high shear dispersion to hold up to 40% organic and 70% inorganic pigment. Unlike other acrylic polymer dispersions, JONCRYL 61LV does not become thixotropic at high pH. JONCRYL 61LV is compatible with caseins, shellacs and resin ester maleics, as well as other acrylic resins.

To a sheet of paper stock, an acrylic resin based composition of Components A, B and C is applied in amounts such that 4 to 12 wet pounds of resin per one thousand square fee of sheet of film are attained. The finished coated paper stock has superior film formation and is compatible for use with cold set glues in corrugated and folding box formation.

During removal of the excess coating applied by the roll to the paper stock, an Airknife TM is used to meter and remove unwanted coating.

The removed coating can be recovered by collecting the coating material blown off the excess coated paper stack in a tray positioned below the Airknife TM for return to a collection pot. The collection pot can be periodically or continually pumped to a main storage tank to be remixed and pumped back into the pan 16 to be reapplied to the paper stock by applicator roll 17.

It is to be understood that although the invention has been described with specific reference to particular embodiments thereof, it is not to be so limited, since changes and alterations therein may be made which are within the full intended scope of this invention as defined by the appended claims.

I claim:

1. A process of making a coated paper or kraft stock comprising the steps of:

providing a paper or kraft stock;

applying an aqueous acrylic resin coating composition as a coating to said paper or stock in an amount in excess of the desired amount of coating;

said aqueous acrylic resin including a zinc oxide solution in an amount sufficient to crosslink the acrylic resin;

metering and removing unwanted coating material from said paper or stock coated with said excess amount of coating material by directing a flow of fluid against said coating;

said coating being metered so as to contain 4 to 12 wet pounds of resin per one thousand square feet of coated paper or kraft stock;

solidfying the coating on aid paper or stock; and obtaining a coated paper or kraft stock.

2. The process of claim 4, wherein the fluid is a directed stream of air.

3. The process of claim 4, wherein the unwanted coating material is recovered and at least some of the recovered material is remixed and applied to said paper or stock.

4. A process of making a coated paper on kraft stock comprising the steps of:

providing a paper or kraft stock;

applying an aqueous acrylic resin coating composition as a coating to said paper or stock in an amount in excess of the desired amount of coating;

wherein the acrylic resin containing composition consists essentially of an aqueous based acrylic resin, a polyethylene wax emulsion and a zinc oxide solution in an amount sufficient to crosslink the acrylic resin.

5. A process of making a coated paper or kraft stock comprising the steps of:

providing a paper or kraft stock;

applying an aqueous acrylic resin coating composition as a coating to said paper or stock in an amount in excess of the desired amount of coating;

wherein the aqueous acrylic resin composition consists of the following components:

(A) 15 parts by weight of an aqueous acrylic resin emulsion having 34.0±0.5% non-volatiles, a pH of 8.3–8.6, a viscosity (Brookfield) of 2500±500 cps, a density of 1.07, an acid number of 70, a $T_g$ of 95° C. and a flashpoint of 115° C.;

(B) 65 parts by weight of an aqueous acrylic resin emulsion having 40% non-volatiles, a pH of 2.5–3.5, a viscosity of 25–35 cps, a weight per gallon of 8.7 pounds, an M.F.T. of 8° C., a $T_g$ of 0° C. and an acid number of 58 (@100% non-volatiles);

(C) 6 parts by weight of an aqueous polyethylene wax emulsion having 34.7–35.3% non-volatiles, a pH of 9.0–9.5 and a weight per gallon of 8.27 pounds;

(D) 5.5 parts by weight HOH;

(E) 0.5 parts by weight $NH_4OH$; and (F) 3 parts by weight zinc oxide solution metering and removing unwanted coating material from said paper or stock coated with said excess amount of coating material by directing a flow of fluid against said coating;

solidifying the coating on said paper or stock; and obtaining a coated paper or kraft stock.

* * * * *